US005795407A

United States Patent [19]

Ishii et al.

[11] Patent Number: 5,795,407

[45] Date of Patent: Aug. 18, 1998

[54] METHOD FOR PRE-TREATING ALUMINUM MATERIALS PRIOR TO PAINTING

[75] Inventors: Hiroshi Ishii, Hiratsuka; Hiroshi Kamio, Kurashiki, both of Japan

[73] Assignee: Henkel Corporation, Plymouth Meeting, Pa.

[21] Appl. No.: 737,503

[22] PCT Filed: May 10, 1995

[86] PCT No.: PCT/US95/05543

§ 371 Date: Nov. 8, 1996

§ 102(e) Date: Nov. 8, 1996

[87] PCT Pub. No.: WO95/31587

PCT Pub. Date: Nov. 23, 1995

[30] Foreign Application Priority Data

May 11, 1994 [JP] Japan ..... 6-097512

[51] Int. Cl.[6] ..... C23C 22/07

[52] U.S. Cl. ..... 148/253; 148/255

[58] Field of Search ..... 148/255, 253

[56] References Cited

U.S. PATENT DOCUMENTS

| | | | |
|---|---|---|---|
| 4,292,096 | 9/1981 | Murakami | 148/255 |
| 4,849,031 | 7/1989 | Hauffe et al. | 148/260 |
| 5,200,000 | 4/1993 | Yamamoto et al. | 148/262 |
| 5,308,413 | 5/1994 | Sobata | 148/255 |

FOREIGN PATENT DOCUMENTS

| | | |
|---|---|---|
| 2058631 | 4/1990 | Canada . |
| 0106459 | 4/1984 | European Pat. Off. . |
| 0264811 | 4/1988 | European Pat. Off. . |
| 0385251 | 9/1990 | European Pat. Off. . |
| 0401616 | 12/1990 | European Pat. Off. . |
| 0407015 | 1/1991 | European Pat. Off. . |
| 0434358 | 6/1991 | European Pat. Off. . |
| 0452638 | 10/1991 | European Pat. Off. . |
| 0659906 | 6/1995 | European Pat. Off. . |
| 63-157879 | 6/1988 | Japan . |
| 02277781 | 11/1990 | Japan . |
| 2199047 | 6/1988 | United Kingdom . |

*Primary Examiner*—David A. Simmons
*Assistant Examiner*—Robert R. Koehler
*Attorney, Agent, or Firm*—Wayne C. Jaeschke; Norvell E. Wisdom, Jr.; Frank E. Robbins

[57] ABSTRACT

To improve the water resisting secondary adhesion of paint films to zinc phosphate conversion coatings on aluminum, the initially formed conversion coating is treated by spraying with a second liquid treatment composition that either is itself a liquid composition capable of forming a zinc phosphate conver- sion coating on aluminum or is made by diluting such a conversion coating forming composition.

14 Claims, No Drawings

METHOD FOR PRE-TREATING ALUMINUM MATERIALS PRIOR TO PAINTING

DESCRIPTION

1. Field of the Invention

This invention concerns a method of pre-treating aluminum materials prior to painting which imparts superior paint film adhesion and corrosion resistance to aluminum and aluminum alloys that contain at least 45 % by weight of alumin- um, these alloys and pure aluminum being referred to hereinafter collectively as "aluminum material", for example, in the form of sheets and die-castings.

2. Statement of Related Art

At the present time, zinc phosphate based conversion coatings and chro- mate treatments are generally being used as means of improving the paint film performance on aluminum materials after painting. From among these treatments, the zinc phosphate based conversion coatings are superior, with respect to less need for effluent treatment to avoid adverse environmental impacts, to the chromate treatments, which involve harmful hexavalent chromium. There is a further advantage for phosphate over chromate treatments in that aluminum materials can be treated together at the same time as other metals, such as cold rolled steel and zinc based coated steel sheets for example, so that these con- version coatings have been widely used as pre-treatments prior to painting auto- mobile bodies and domestic electrical appliances.

In the past it has been more difficult to form a uniform zinc phosphate based conversion coating continuously with aluminum materials than with other metal substrates, such as iron and steel sheets and zinc plated steel sheets for example. However, at the present time, methods in which aluminum ions are re- moved from the system as a precipitate by adding specified additives to the treatment liquid (cf. Japanese patent Kokai H2-277781) and methods in which uniform etching is carried out and the uniformity of the phosphate film is ensured by controlling the fluoride concentration in the treatment liquid (cf. Japanese patent Kokai 63-157879), for example, have been developed, and it has become possible to form a uniform zinc phosphate based conversion coating continu- ously.

However, while providing good corrosion resistance with uniform film formation, zinc phosphate based conversion coatings sometimes do not achieve a satisfactory performance with respect to adhesion of the paint film, especially the secondary adhesion, where it is assumed that moisture will have been absorbed (referred to hereinafter as the "water resisting secondary adhesion"), when exposed to the natural environment for a prolonged period. Thus, the development of a method of pre-treating aluminum materials prior to painting which satisfies the requirements of corrosion resistance after painting and water resisting secondary adhesion at the same time is required.

PROBLEMS TO BE SOLVED BY THE INVENTION

This present invention is for solving problems such as those noted above in connection with the prior art, and, in practical terms, it is intended to provide a method of pre-treating aluminum materials prior to painting which can impart superior corrosion resistance and water resisting secondary adhesion to aluminum materials after painting.

SUMMARY OF THE INVENTION

The inventors have discovered that: (1) a conversion coating which has been formed by a dipping treatment exhibits better painting performance than one obtained using a spray treatment; (2) the corrosion resistance after painting increases as the film weight is increased; (3) it is necessary to increase the fluorine component concentration in the treatment liquid to a specified concentration in order to obtain a satisfactory film weight; (4) in those cases where an aluminum material is treated with a zinc phosphate conversion coating composition which contains a fluorine component, a compound that contains fluorine, along with the zinc phosphate which is the main component of the conversion coating, is precipitated, this compound being referred to below as a fluoride based coprecipitate, and the water resisting secondary adhesion of the paint film is worsened; and (5) the amount of fluoride based co-precipitate which is precipitated also increases as the fluorine component concentration in the treatment liquid becomes higher, and the water resisting secondary adhesion worsens.

On the basis of these findings, it has become clear that a process for the removal of the fluoride based co-precipitate which has an adverse effect on the water resisting secondary adhesion is required, after carrying out the film forming process with a dipping treatment using a zinc phosphate based chemical forming treatment liquid which contains a specified concentration of fluorine component, in order to obtain a zinc phosphate based conversion coating which is satisfactory in terms of both corrosion resistance after painting and water resisting secondary adhesion.

Thus, the inventors have now found that a fixed time spraying treatment using the liquid conversion coating composition itself, or a diluted liquid conversion coating composition, is effective, and the invention is based upon this finding.

DETAILS OF THE INVENTION AND OF PREFERRED EMBODIMENTS

The present invention concerns a method of pre-treating aluminum material prior to painting, wherein, after subjecting the aluminum material to contact, preferably by a dipping treatment, for 1.5 –5.0 minutes inma first zinc phosphate based conversion coating composition which contains 500 –1500 parts per million by weight (hereinafter usually abbreviated as "ppm"), calculated as fluorine, of a fluorine component, treating the surface and forming a zinc phosphate based conversion coating, preferably one with a film weight in the range from 1.0 –3.0 grams per square meter (hereinafter usually abbreviated as "g/m2") on said surface, the surface is spray treated for 1.0 –4.0 minutes with a second treatment liquid, this second treatment liquid being either (i) a zinc phosphate based conversion coating composition or (ii) a composition made by diluting a zinc phosphate based conversion coating composition, the concentrations of the components effective to form a zinc phosphate film when present in adequate concentrations, more particularly the fluorine concentration, in said second treatment liquid being from 1 –1/15 of the concentrations of the same active ingredients of the first zinc phosphate based conversion coating composition.

The zinc phosphate based conversion coating composition which is used in the invention contains phosphate ions, zinc ions, accelerator compounds or ions, and other additives as the active ingredients which are used in film fornation. The types and concentrations are as usual, and those disclosed, for example, in the column "Zinc phosphate Method" in the table on page 79 of *Nihon parkerizing Technical Reporter*, 88, No.1 (published 3rd Jul. 1988) or in Table 1 on page 8 of *Nihon parkedzing Technical Reporter* 92, No.5 (published 16th Feb. 1992) can be used. Furthermore, the zinc phosphate based conversion coating compositions which have been disclosed in the above-mentioned patents can also be used. In this present invention, spraying is carried out with the second treatment liquid, in which the concentration of the active ingredients of the zinc phosphate based conversion coating composition is lower than, or the same as, that of the first treatment liquid which was used for film formation. Methods such as direct dilution of the first treatment liquid with water, mixing the first treatment liquid with a zinc phosphate based conversion coating composition which has been previously diluted with water, or mixing the first treatment liquid with a zinc phosphate based conversion coating composition which does not contain fluorine, for example, can be adopted to reduce the concentration. However, making the first treatment liquid into the second treatment liquid either as it is or by dilution with water are most desirable in industrial terms.

That is to say, the preferred embodiments of the invention are a method of pre-treatment of aluminum materials prior to painting, as disclosed above, wherein the first zinc phosphate based conversion coating composition is made into the second treatment liquid by diluting not more than 15 times with water, and a method of pre-treating aluminum materials prior to painting, as disclosed above, wherein the first zinc phosphate based conversion coating composition, without dilution, is used as the second treatment liquid. These embodiments of the present invention are described in detail below.

The fluorine component is included in the zinc phosphate based conversion coating composition used in the invention in an amount, calculated as its stoichiometric equivalent as fluorine, of 500 –1500 ppm. If the fluorine component, calculated as fluorine, is less than 500 ppm, then etching is usually inadequate, so that a good film is not formed, and if it is added in excess of 1500 ppm, this normally results in a worsening of adhesion, and the amount of fluoride based co-precipitate which is precipitated out becomes excessive, and this is undesirable. Moreover, fluorides, such as hydrofluoric acid, sodium hydrogen fluoride, sodium fluoride, and ammonium fluoride for example, and complex fluorides such as fluosilicic acid, sodium silicofluoride, and fluozirconic acid for example, can be used for the fluorine component in the treatment liquid. In general, one or two or more than two of these are added to the conversion coating composition.

The film forming process in this present invention preferably is a treatment by means of a dipping method, and a good film which gives a satisfactory painting performance usually can not be obtained with a spray treatment. A satisfactory film weight is not usually obtained in cases where the treatment time is less than 1.5 minutes, and in cases where the time exceeds 5.0 minutes, the conversion coating reaction has reached saturation, so that longer times are uneconomical.

Next, the film weight of the zinc phosphate based conversion coating preferably is within the range from 1.0 to 3.0 $g/m^2$. If it is less than 1.0 $g/m^2$, a satisfactory corrosion resistance after painting usually is not obtained, and if it exceeds 3.0 $g/m^2$, not only may there be no further corrosion resistance after painting, but there are also cases where this leads to a deterioration in paint film adhesion, so that it is usually undesirable.

The second treatment liquid, which is diluted to a dilution factor of 1 –1/15 , is sprayed in a separate process step following conversion coating film formation with the earlier, preferably dipping, treatment, so that the fluorine based co-precipitate which is attached to the surface of the aluminum materials is removed. The "dilution factor" is defined as the ratio of the fluorine concentration in the liquid used for the dipping treatment to the fluorine concentration in the liquid used for the spraying treatment. A dilution factor of less than 1 time signifies concentration; the preparation of the treatment liquid is then difficult and the fluorine component concentration in the liquid may become excessive, so that such a second treatment liquid often has an unsatisfactory action for removing the fluorine based co-precipitate. On the other hand, second conversion coating compositions with a dilution factor of more than 15 times are usually inadequate in their ability to remove the fluorine based co-precipitate, as they lack sufficient acidity. Moreover, water is most conveniently and thus preferably used to dilute the first treatment liquid, and no problems arise even when process water or tap water which contains the hardness components calcium and magnesium is used.

A spray treatment process time of 1.0 –4.0 minutes is preferred. If it is less than 1 minute, a satisfactory fluorine based co-precipitate removing action usually is not obtained, and if it exceeds 4.0 minutes then the removal effect is usually not further improved. However, the spray treatment in this process may be carried out in a number of intermediate stages, while standing by for the next process, or during water rinsing or transportation for example, and at these times it is possible to use treatment liquids which have different dilution factors, provided that the cumulated treatment time is 1.0 –4.0 minutes, there is no reduction in the beneficial effect of the invention.

preferably, in order to avoid unneeded process steps, there is no additional dipping treatment of the surfaces being processed according to the invention with any zinc phosphate conversion coating forming composition, after the spraying treatment process(es) described immediately above.

Moreover, when the invention is being executed industrially, the fundamental treatment processes by which the aluminum material is surface treated preferably are carried out in the following order: alkaline degreasing, water rinsing, titanium colloid based surface activation, zinc phosphate based conversion coating using a treatment liquid which contains fluoride (preferably by dipping treatment), spraying treatment using the treatment liquid or diluted treatment liquid from the previous process, water rinsing and deionized water rinsing. Subsequently, the after-treatment process(es) by which painting or the provision of a like protective coating is achieved are usually carried out as previously known per se in the art.

A separate treatment step with the treatment liquid or diluted treatment liquid from the previous process, between (i) the formation of a zinc phosphate based coating process on aluminum material using a liquid coating composition which contains fluoride and (ii) painting, is the major distinguishing feature of the present invention. The treatment step with the first treatment liquid or diluted second treatment liquid must be carried out at least once, but it can be carried out in a number of stages. Furthermore, in different stages the multi-stage treatment can be carried out using treatment baths with different dilution factors.

When the method of this present invention is used on an actual line for continuous treatment, equipment which can provide a second treatment after the treatment that forms the conversion coating is newly installed, or if existing apparatus is present for the spray treatment, this can be made suitable for a process according to the invention by installing a primary conversion coating forming treatment tank before the spray treatment. Moreover, in cases where the existing plant is for a dipping treatment, methods in which the second treatment stage is provided by spraying upon removing the treated material from the tank over the dipping treatment tank, and, in cases where the water rinse process after the dipping treatment is a multi-stage process, methods in which the treatment liquid is admixed with the rinse water in the immediately following water rinse process, or methods in which both of these techniques are employed, for example, can be used.

Moreover, the first zinc phosphate based conversion coating composition in this present invention is a treatment liquid which can be used for metal materials in general, and if the method of treatment of this present invention is carried out with materials other than aluminum, such as steel sheet and zinc based plated steel sheet, the conversion coating which has been formed by the dipping process will not normally be damaged by the subsequent spray treatment using the second treatment liquid.

Furthermore, with aluminum materials, mechanical strain of the material which has been generated during the working process is usually corrected by mechanical grinding, and the painting performance, and especially the paint film adhesion, on a material surface which has been ground is generally poor. If the fluoride based co-precipitate is removed by the method of pre-treating prior to painting of this present invention, the conversion coating acts effectively even on such ground surfaces, and it is possible to achieve excellent paint film performance.

There are dipping methods and spraying methods for the zinc phosphate based chemical forming treatment of aluminum materials, but the dipping method is better as a method of film formation for improving the corrosion resistance after painting and paint film adhesion. It is believed that this is due to better alkali dissolution resistance of a film which has been formed by the dipping method.

A fluorine component must be present in the first conversion coating composition to which the aluminum material is subjected in order to generate on the surface a zinc phosphate based conversion. Etching of the aluminum material is not achieved satisfactorily in those cases where no fluorine component is added, so that the chemical forming reaction does not proceed. The material surface is etched by the fluorine component and the aluminum ions which have been dissolved out into the treatment liquid are mostly precipitated and removed, together with some fluoride ions and sodium ions in the treatment liquid, in the form of cryolite, but some are precipitated as fluoride based co-precipitate on the surface of the conversion coating which has been formed and cause the paint film performance after painting to deteriorate.

The fluoride based co-precipitate has not been identified as a specific compound, but it is thought to contain aluminum and fluorine and, in some cases, sodium, and it is conjectured that it is a compound such as aluminum fluoride or cryolite. However, this co-precipitate is a compound which usually is precipitated unavoidably in cases where treatment is carried out with a conversion coating composition which contains a fluorine component, so that it is necessary to remove such a co-precipitate from the aluminum material surface in a process after the dipping treatment in order to avoid continued presence of the co-precipitate underlying subsequently applied paint or a like protective coating and diminishing its protective ability.

The fluoride based co-precipitate is believed to be a compound which contains aluminum, as described above, so that it can be dissolved and removed by bringing the aluminum material surface into contact with an aqueous solution which does not contain aluminum. Hence, it was initially thought that the fluoride based co-precipitate could be removed gradually if the dipping treatment was continued in a phosphate conversion coating composition which did not contain aluminum, but in fact, aluminum dissolution from the material surface continues, so that aluminum ions generally appear in the vicinity of the material surface, and removing them with a dipping process is quite difficult.

However, the fluoride based co-precipitate can be removed with good efficiency if treatment is carried out in such a way that the aluminum ion diffuses rapidly into the treatment liquid, and the use of a spraying treatment as in this present invention is effective for this purpose. Moreover, by using the first treatment liquid from the dipping treatment of the previous process or a diluted form of this treatment liquid for the second treatment liquid which is used in the spraying treatment, the fluoride based co-precipitate can be removed rather than the weakly bonded crystals which are attached to the surface of the conversion coating, which has been formed on the aluminum material surface, and it is possible to achieve a great improvement in painting performance.

Examples and Comparative Examples

Some examples of actual treatments are indicated below, together with comparative examples, and the effect of the invention is described in more prac- tical terms.

1. Substrate Materials Tested Aluminum alloy (JIS-A5052) sheets with a thickness of 1.0 mm were used as substrate materials for testing purposes. These were shaped to rectangles 70 ×150 mm and subjected to the treatments of the examples and comparative examples described below.

The treated test sheets were evaluated in terms of paint film adhesion after painting by water resisting secondary adhesion tests and in terms of corrosion resistance with outdoor exposure tests using the methods indicated below.

2. Treatment process Steps (1) Degreasing with FINECLEANERO® L4460 alkaline degreasing agent, manufactured by Nihon parkerizing Co. Ltd., at 43° C. for 120 seconds by spraying.

(2) Water rinse with tap water at normal ambient temperature for 30 seconds by spraying.

(3) Surface activation with PREPALENE® ZN titanium colloid based surface activating agent, manufactured by Nihon parkerizing Co. Ltd., at normal ambient temperature for 30 seconds by spraying.

(4) Zinc phosphate based conversion coating at 43° C. by dipping into a liquid composition based on PALBOND® L3020 conversion coating forming liquid concentrate, manufactured by Nihon parkerizing Co. Ltd., the composition as used for forming a conversion coating having a Free Acidity (defined as the number of milliliters, hereinafter usually abbreviated as "ml", of 0.1 N sodium hydroxide required to fitrate 10 ml of treatment liquid to an end point with bromophenol blue as indicator) of 0.9 points, a Total Acidity (defined as the number of ml of 0.1N sodium hydroxide required to titrate 10 ml of treatment liquid to an end point with phenolphthalein as indicator) of 22 points, and a nitrite accelerant concentration of 3 points (as determined by a saccharometer); the fluorine component concentration in the treatment liquid is shown in Table 1 and the treatment time is shown in Table 2.

TABLE 1

| Treatment Liquid Number | Stoichiometric Equivalent as Fluorine in ppm Derived from: Hydrofluoric Acid | Fluosilicic Acid | All Sources |
|---|---|---|---|
| 1 | 600 | 0 | 600 |
| 2 | 0 | 1000 | 1000 |
| 3 | 400 | 1000 | 1400 |
| 4 | 400 | 0 | 400 |
| 5 | 1000 | 600 | 1600 |

(5) Second treatment at 35° C. by spraying for a treatment time as shown in Table 2, with a second treatment liquid, which had the same chemical composition as was used in step (4) or a composition prepared by diluting a liquid with the same composition used for step (4) with water to produce a dilution factor as shown in Table 2.

(6) Water rinse with tap water at normal ambient temperature for 30 seconds by spraying for a treatment time as shown in Table 2.

TABLE 2

| Example or Comparative Example No. | Dipping Treatment Conditions: Treatment Liquid | Treatment Time, Min | Spraying Treatment Conditions: Dilution Factor | Treatment Time, Min |
|---|---|---|---|---|
| Example 1 | 1 | 2.0 | 2 | 2.0 |
| Example 2 | 1 | 2.8 | 14 | 3.8 |
| Example 3 | 2 | 1.6 | 1 | 1.5 |
| Example 4 | 2 | 4.8 | 10 | 1.1 |
| Example 5 | 3 | 2.0 | 8 | 2.5 |
| Example 6 | 3 | 3.2 | * | * |
| Com. Ex. 1 | 1 | 1.4 | 5 | 2.5 |
| Com. Ex. 2 | 2 | 2.0 | 10 | 0.9 |
| Com. Ex. 3 | 3 | 4.5 | 1 | 3.5 |
| Com. Ex. 4 | 4 | 2.0 | 8 | 1.5 |
| Com. Ex. 5 | 5 | 2.0 | 16 | 1.3 |

Notes for Table 2
*Spray treated for 2.5 minutes with a dilution factor of 1.0 and then spray treated for 1.3 minutes with a liquid having a dilution factor of 14, for a total spray treatment time of 3.8 minutes.
"Com. Ex." = Comparative Example.

(7) Deionized water rinse, with water having an electrical conductivity of 0.2 microSiemens per centimeter, at normal ambient temperature for 20 sec- onds by spraying.

(8) Draining and drying at 110° C. for 180 seconds.

(9) Electrodeposition painting with ELECRON® 2000 cationic electrodeposi- tion paint, manufactured by the Kansai paint Co., at 28° C. with a voltage of 250 Volts for 180 seconds to produce a film thickness of 20 micromet- ers, followed by baking at 170° C. for 20 minutes.

The mass ("M1" grams) of the treated plate after the dipping treatment was measured; then the film was stripped away from the treated sheet using a 5 % aqueous solution of chromic acid anhydride at normal ambient temperature for 5 minutes, the mass was measured again ("M2" grams), and the areal density of the film was calculated using the following equation:

$$\text{Film Areal Density in g/m}^2 = (M1-M2)/0.021.$$

(2) paint Film Adhesion Tests (Water Resisting Secondary Adhesion Tests) Test sheets prepared in accordance with the processes (1) –(9) were im- mersed in deionized water at 40° C. for 240 hours and then cuts which reached the base material were made with a sharp cutter on the test sheets which had been removed from the water. parallel cuts were made with a 1 mm spacing and then 11 parallel cuts were made at right angles to these cuts again with 1 mm spacing, so that a pattern of 100 squares was formed by the cuts. Cello- phane tape was applied over and then peeled from these squares, the number of cut squares which peeled more than 50 % was noted, and an evaluation was made on the basis of the following standards.

Paint Film Adhesion Evaluation Standards

| Number of Squares Peeled | Assessment |
|---|---|
| None | ○ |
| 1–10 | Δ |
| More than 10 | x |

(3) Corrosion Resistance Tests (Outdoor Exposure Tests)

Cross cuts reaching the base material were introduced with a sharp cutter on painted sheets prepared using the processes (1) –(9) and outdoor exposure tests were carried out. Twice a week during the outdoor exposure, salt water spraying (with 5 % salt water) was carried out. The tests were continued for 9 weeks, the width of the greatest extension in the width direction on either side from the cross cuts was measured, and an evaluation was made on the basis of the following standards.

Corrosion Resistance Evaluation Standards

| One-Side Width of Greatest Extension | Assessment |
|---|---|
| Less than 2 mm | ○ |
| More than 2 mm but not more than 4 mm | Δ |
| More than 4 mm | x |

TABLE 3

| Identification | Film Areal Density in g/m² | Paint Film Adhesion Rating | Corrosion Resistance Rating |
|---|---|---|---|
| Example 1 | 1.7 | ○ | ○ |
| Example 2 | 2.6 | ○ | ○ |
| Example 3 | 1.2 | ○ | ○ |
| Example 4 | 2.8 | ○ | ○ |
| Example 5 | 1.8 | ○ | ○ |
| Example 6 | 2.5 | ○ | ○ |
| Com. Ex. 1 | 0.8 | Δ | x |
| Com. Ex. 2 | 1.7 | x | Δ |
| Com. Ex. 3 | 3.2 | Δ | Δ |
| Com. Ex. 4 | 0.5 | x | x |
| Com. Ex. 5 | 2.2 | x | Δ |

As shown in Table 2 and Table 3, is clear that Examples 1 –6 in which treatment liquids 1 –3 of which the fluorine component in the treatment liquid was within the scope of the invention were used, and with which the dipping treatment conditions, the film weight after the dipping treatment and the spraying conditions were also within the scope of the invention, exhibited good perform- ance in terms of the paint film adhesion after painting and corrosion resistance.

On the other hand, it is clear that, in comparison with the method of this invention, Comparative Example 1 in which the dipping treatment time was short and the film weight after the dipping treatment was low, Comparative Example 2 in which the spraying treatment time was short, Comparative Example 3 in which the film weight after the dipping treatment was high, Comparative Example 4 in which the fluorine component concentration in the treatment liquid was low and the film weight after the dipping treatment was low, and Comparative Example 5 in which the fluorine component concentration in the treatment liquid was high and the dilution factor of the spraying treatment liquid was high did not give a satisfactory painting performance.

Benefits of the Invention

The method of pre-treating aluminum material prior to painting in accord- ance with this present invention in this way has as a major distinguishing feature the fact that a zinc phosphate based conversion coating is formed by means of a dipping process and then a spray treatment is carried out with this treatment liquid or a treatment liquid in which the active ingredients concentration is 1–1/15 times that of said treatment liquid, and it is possible to increase markedly the paint performance, and especially the paint film adhesion, without damaging the conversion coating on the surface of the aluminum material by means of such a treatment which is simple in operation. Furthermore, it is a method of pre-treatment prior to painting which is of great practical effect in that, for example, existing treatment facilities can be modified slightly the above-mentioned two-stage treatment, and in that there is no need for the addition of special reagents, etc.

The invention claimed is:

1. A method of treating surfaces of aluminum materials, said method comprising steps of:

(A) subjecting the surface to a dipping treatment in a first zinc phosphate based conversion coating composition which contains from 500 to 1500 ppm, calculated as fluorine, of a fluorine containing component, so as to form a zinc phosphate based conversion coating on said surface;

(B) spraying the surface after step (A) with a second treatment liquid which is either a zinc phosphate based conversion coating liquid composition itself, or is made by diluting such a zinc phosphate based conversion coating liquid composition, the concentration of the active ingredients in the second treatment liquid being from 1 –1/15 of the concentration of the active ingredients of the first zinc phosphate based conversion coating composition.

2. A method as claimed in claim 1, wherein step (A) is continued for from 1.5 to 5.0 minutes.

3. A method as claimed in claim 2, wherein the conversion coating formed in step (A) has an areal density from 1.0 to 3.0 g/m$^2$.

4. A method as claimed in claim 1, wherein the conversion coating formed in step (A) has an areal density from 1.0 to 3.0 g/m$^2$.

5. A method as claimed in claim 4, wherein step (B) is continued for from 1.0 to 4.0 minutes.

6. A method as claimed in claim 3, wherein step (B) is continued for from 1.0 to 4.0 minutes.

7. A method as claimed in claim 2, wherein step (B) is continued for from 1.0 to 4.0 minutes.

8. A method as claimed in claim 1, wherein step (B) is continued for from 1.0 to 4.0 minutes.

9. A method as claimed In claim 1, wherein the frst zinc phosphate based conversion coating 4position is made into the second treatment liquid by diluting with water to result in a dilution motor of not more tham 15.

10. A method of treating the surface of an aluminum material, said method comprising steps of:

(A) subjecting said surface to a dipping treatment in a first zinc phosphate based conversion coating composition which contains from 500 ppm to 1500 ppm, calculated as fluorine, of a fluorine containing component, so as to form a zinc phosphate based conversion coating on said surface; and (B) spraying said surface after step (A) with a second treatment liquid, wherein said first phosphate based conversion coating composition is made into the second treatment composition by diluting it with water to result in a dilution factor of not more than 15.

11. A method as claimed in claim 10 wherein the conversion coating formed in step (A) has areal density from 1.0 g/m$^2$ to 3.0 g/m$^2$ and wherein step (A) is continued for from 1.0 to 4.0 minutes.

12. A method as claimed in claim 10 wherein in step (A) is continued for from 1.0 –4 minutes .

13. A method as claimed in claim 10 wherein the conversion coating formed in step. (A) has areal density from 1.0 g/m$^2$ to 3.0 g/m$^2$ .

14. A method as claimed in claim 13 wherein step (A) is continued for from 1.5 to 5.0 minutes.

* * * * *